United States Patent [19]

Deaton

[11] 4,386,700

[45] Jun. 7, 1983

[54] DRAIN CONTROL FOR MULTIPLE STACKED CONTAINERS

[75] Inventor: Thomas P. Deaton, Mason, Ohio

[73] Assignee: Nestier Corporation, Cincinnati, Ohio

[21] Appl. No.: 267,915

[22] Filed: May 28, 1981

[51] Int. Cl.[3] ..... B65D 21/04

[52] U.S. Cl. ..... 206/507; 220/1 C; 220/DIG. 6

[58] Field of Search ..... 206/507; 220/1 C, DIG. 6

[56] References Cited

U.S. PATENT DOCUMENTS 3,902,599 9/1975 Stromberg .

FOREIGN PATENT DOCUMENTS 2433734 1/1976 Fed. Rep. of Germany ... 220/DIG. 6

1411494 8/1965 France .

103245 2/1964 Norway ..... 206/507

401594 4/1974 U.S.S.R. .

*Primary Examiner*—George E. Lowrance

*Attorney, Agent, or Firm*—Thomas E. Beall, Jr.

[57] ABSTRACT

A plurality of identical open top containers may be vertically stacked or vertically adjacent containers may be rotated 180° relative to a vertical axis and nested, for the transport of items, such as fish, involving liquid that is desirably drained from each container. Drainage from one container into a lower container and therefore contamination of the lower container is prevented by drain holes in each of the stacking feet communicating directly with the upper inlet end of a downwardly and outwardly sloping channel in the support portion of the next lower container, in the stacked position, with an integral flange extending continuously around the entire top periphery of each box overlying the channel for strength and continuity. Each channel extends directly to the outside and perpendicularly to the adjacent end wall, separate from the other channels, and ends vertically above the outside of the flange for the next lowest box that is outwardly sloped to provide for a run-off to the outside, with the inner portion of the flange communicating directly with its channel to further prevent liquid entering its container.

19 Claims, 12 Drawing Figures

DRAIN CONTROL FOR MULTIPLE STACKED CONTAINERS

BACKGROUND OF THE INVENTION

The present invention relates to a stackable and nestable container for the transport of material wherein liquid drainage from the container is desired.

Such containers are generally used in the transport and storage of material, which involves vertical stacking of a plurality of containers that are heavily loaded, and therefore require strength in the container. Further strength and rigidity of the container is required in the actual movement of the containers either singly or in stacks from one location to another whether manually, automatically or in stacked condition in the truck or the like transport vehicle. Such movement places considerable stress on the containers. Therefore, the strength and integrity of the containers is a requirement.

Drainage from such containers is provided through an aperture in the bottom of the containers where liquid tends to collect from the material being transported. This is particularly important with respect to such items as fish, wherein ice is many times used to cool the fish, but in doing so the ice melts and produces a liquid that is desirably removed from the container as it is formed. Merely placing one or more holes in the bottom of a container is unsatisfactory, because drainage of one container will be into the next lower container of a stack, so as to provide a cumulative effect of drainage liquid as you proceed vertically down the stack, and more importantly to result in contamination of subsequent lower containers. Contamination would seem to be a considerable problem if there is spoilage of an item towards the top of the stack or if one of the top containers contains a material that does not belong in the container and is detrimental to the material that does belong in the container. Spoilage of material in a container or the presence of material that does not belong in the container can be discovered, and dealt with with respect to that one container, but usually too late to identify lower containers that were stacked with it and thereby contaminated. Even if the other containers that have been contaminated were identified, this would result in considerable wastage.

An important consideration in design of any container is its volume efficiency, which can be expressed as a ratio of its interior useful volume to its exterior required volume when associated with other containers, for example when loading a truck.

While drainage of one container to its outside so as not to contaminate other lower containers in a stack is desired, such is generally detrimental to the container's strength, volume efficiency, economy of manufacture, and other desirable characteristics of the container.

SUMMARY

It is an object of the present invention to provide the desirable characteristics of providing drainage in a stackable, nestable container without contamination in a vertical stack, while either not adversely affecting or adversely affecting to a minimum other desirable characteristics of a container, such as economy, strength, and volume efficiency. These and other objects are provided by the present invention.

DETAILED DESCRIPTION OF A PREFERRED EMBODIMENT

Figure 1:
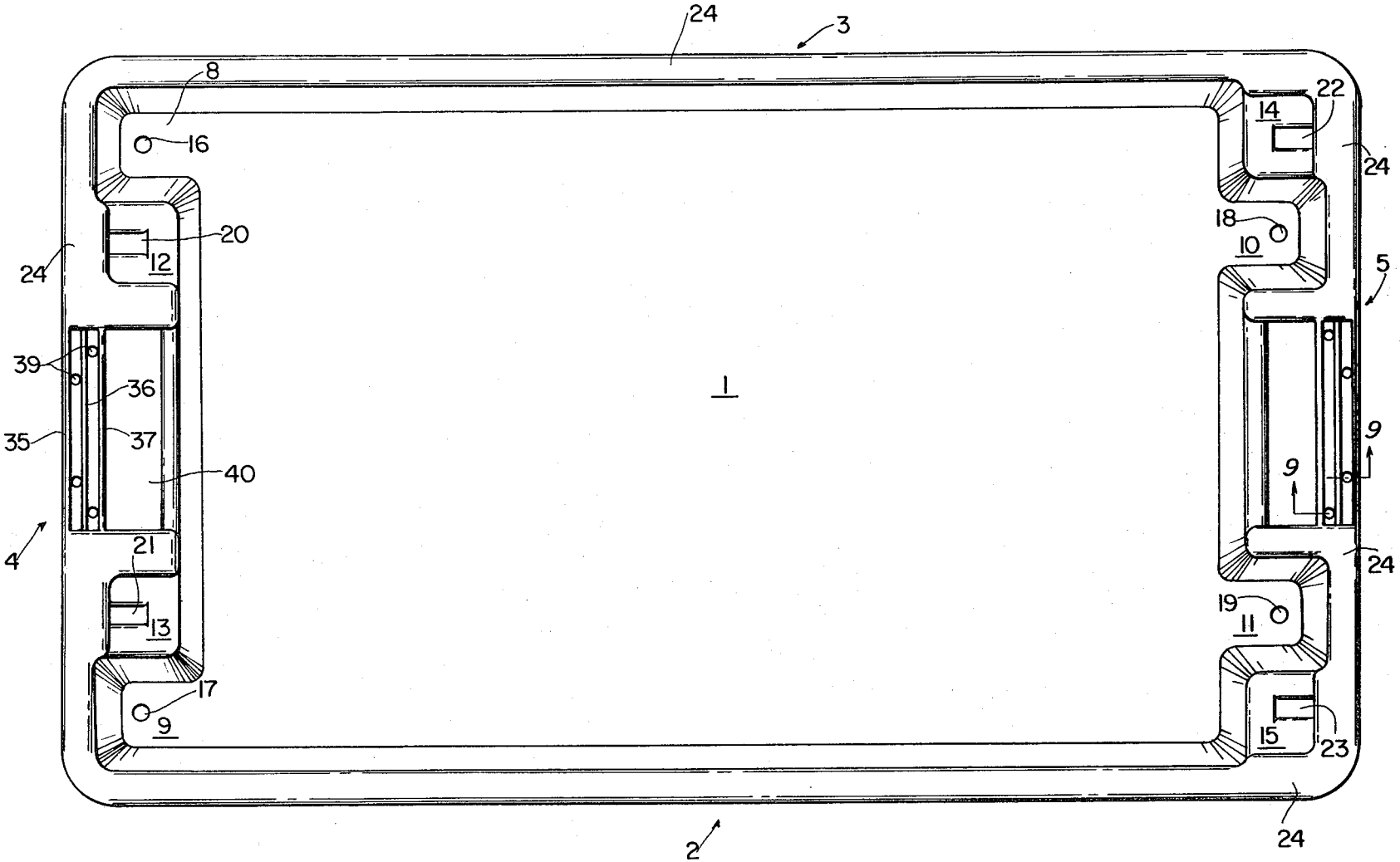
FIG. 1 is a top plan view looking down on a container constructed according to the present invention, without a top.

One embodiment of the present invention has been shown in detail in the drawing, and will be described in detail hereinafter, as an example of the present invention. The embodiment will be described with respect to its normal vertical position wherein its bottom is resting on a horizontal flat surface, for convenience.

The container is molded, preferably from a synthetic resin, in one integral piece.

Figure 7:
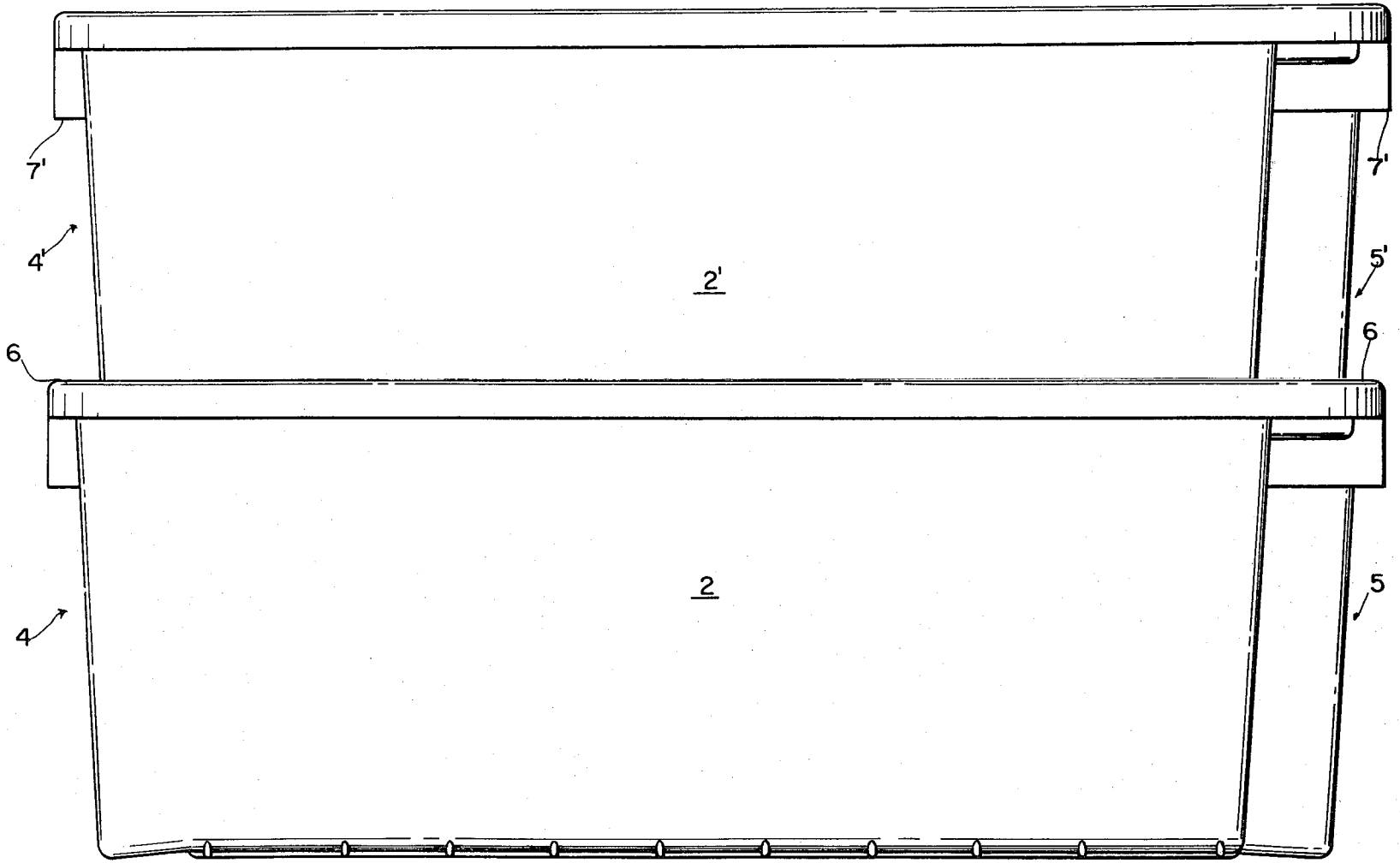
FIG. 7 is a side elevation view similar to FIG. 3, showing two such containers stacked on each other.

The container includes a bottom 1, first side wall 2, second side wall 3, one end wall 4, and an opposite other end wall 5 that are all integrally joined together from a homogeneous molding to form a generally open top rectangular container. The containers are constructed with means, to be described more fully hereinafter, that permit a plurality of identical containers to assume a first stacked position as shown in FIG. 7 wherein the bottom of the upward container having walls 2', 4', 5' is adjacent to the topmost portion of the side walls, including 2, and end walls 4, 5 of the lower container, and further permit a second nested position of 180° relative rotation as between the containers about a vertical axis wherein the containers may then be telescopically nested with the bottom of the upper container adjacent to the bottom of a lower container. The nested position is not shown in the drawing, but is readily understood in view of the fact that all of the containers will be identical and the side and end walls slant upwardly and outwardly to permit such nesting, wherein the uppermost surface 6 of the lower container would engage the abutment surface 7' of the upward container.

To accomplish the above-mentioned stacking and nesting, the containers are provided with foot portions, end wall columns, and seat portions. Two foot portions 8, 9 are provided at the intersection of the bottom 1 and the one end wall 4 closely adjacent the respective side walls 3, 2. The foot portions 10, 11 of the other end wall 5 are inwardly spaced from their respective side walls 3, 2. Two seat portions 12, 13 are formed in the end wall 4 inwardly spaced from the adjacent, as seen in plan view, foot portions 8, 9. The end wall 5 is provided with similar seat portions 14, 15 outwardly adjacent, as seen in plan view, the foot portions 10, 11. The seat portions 12, 13, 14, 15 are closely adjacent the topmost portion of the container, that is vertically spaced considerably above the foot portions. Therefore, in the first stacked position, the one end wall 4 of the lower container is vertically aligned with the other end wall 5' of the upper container and foot portions engage respective seat portions to provide the vertical support of the upward container on the lower container. In the first stacked position: foot portion 11 would engage seat portion 12 of another container; foot portion 10 would engage seat portion 13 of another container; foot portion 9 would engage seat portion 14 of another container; foot portion 8 would engage seat portion 15 of another container; that is, a foot portion of the upward container would engage the seat portion of the lower container that corresponds to the seat portion of the upward container that is diametrically opposite to the foot portion.

The top surface of the bottom wall is preferably either flat or slightly sloped to its four corners, to provide for drainage of the liquid through four drainage holes 16–19 respectively provided in the foot portions 8–11. Preferably, these are the only drainage holes in or adjacent the bottom wall 1. The drainage holes 16–19 extend through the bottom wall within their foot portions to provide for drainage of a liquid within the container through said drainage holes to the exterior of the container.

Drainage channels 20–23 are provided respectively in each of the seat portions 12–15. Each of these drainage channels is generally U-shaped in vertical cross section taken perpendicular to the longitudinal axis of the container. Each drainage channel extends from a position vertically aligned with the drainage hole of an upward container in the first stacked position downwardly and outwardly through an adjacent wall of its container. Particularly, each drainage channel extends directly and separately immediately outward through the end wall, which provides for a short distance and therefore a considerable slope for the drainage channel.

Figure 8:
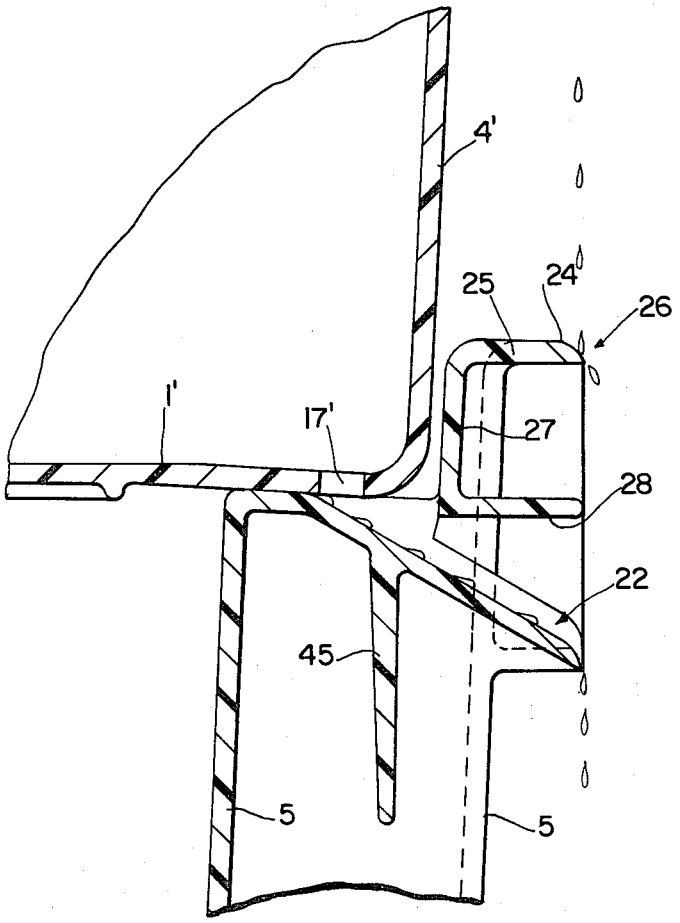
FIG. 8 is a partial cross sectional view taken through the stacked containers in FIG. 7.
Figure 9:
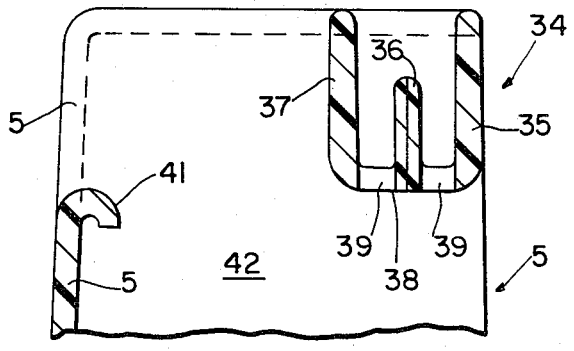
FIG. 9 is a partial cross sectional view taken along line 9—9 of FIG. 1.
Figure 10:
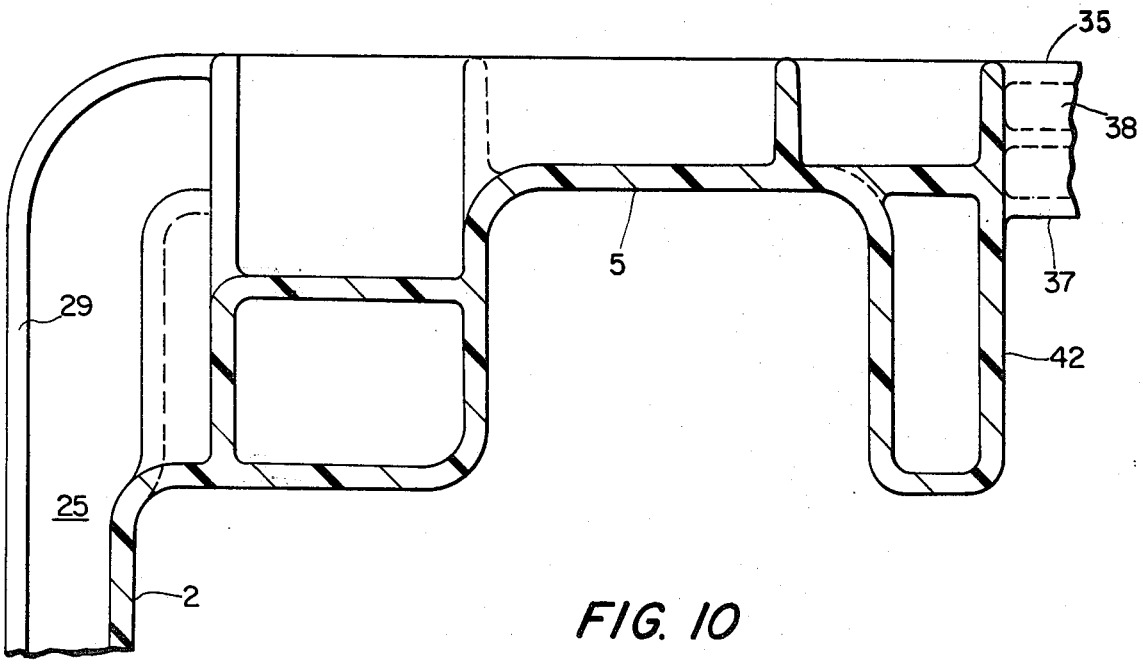
FIG. 10 is a cross sectional view taken along line 10—10 of FIG. 5.
Figure 11:
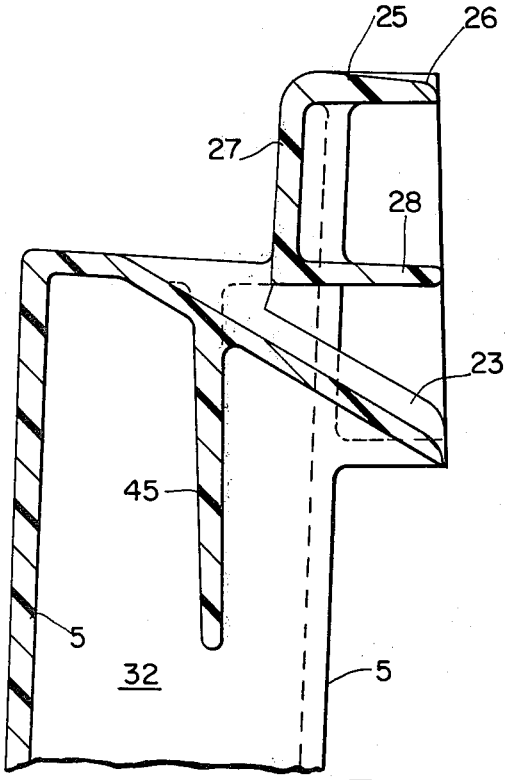
FIG. 11 is a cross sectional view taken along line 11—11 of FIG. 5.
Figure 12:
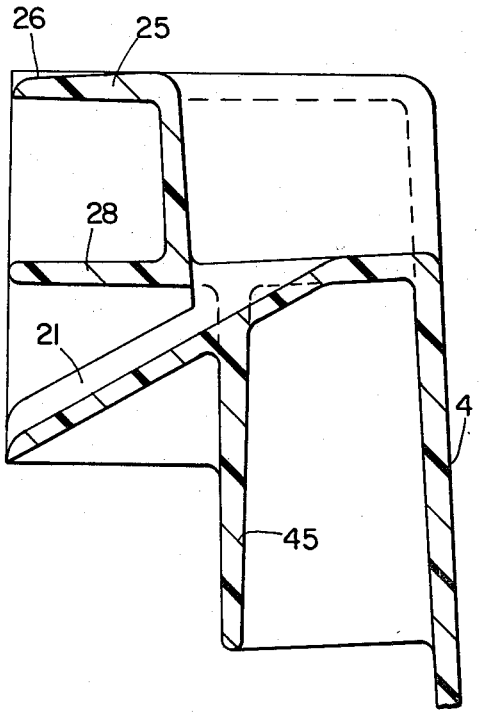
FIG. 12 is a cross sectional view taken along line 12—12 of FIG. 6.

The container includes an integral flange 24 as a part of its one-piece construction. The flange 24 extends horizontally and continuously around the entire upper periphery of each of the side walls 2, 3 and end walls 4, 5 in a closed loop. From FIG. 8, it is seen that the flange 24 has a portion vertically spaced above and covering each channel, which as seen, will prevent drippage from an upward container from entering into the channel of a lower container, and further which will provide for strengthening in an area that would otherwise be weakened by the existence of the channel. The flange 24 while continuous around the periphery, includes a horizontal wall 25 that is continuous with a generally rectangular external dimensioning and contained within a single horizontal plane. This flange wall 25 includes an outer portion, directly vertically above each channel that is downwardly and outwardly sloped at 26 so that drippage or the like from an upper container will tend to flow outwardly as shown, rather than inwardly. The flange 24, in the vicinity of each channel, further includes a vertical wall portion 27 (FIG. 8) leading downwardly from the wall 25 into a mid-portion of the adjacent channel, and a lower horizontal wall portion 28 parallel to the wall portion 25 for reinforcement and further protection of the channel. Although shown with respect to only one channel 22, the view of FIG. 8 is typical for each channel and adjacent container in the stacked position.

Figure 5:
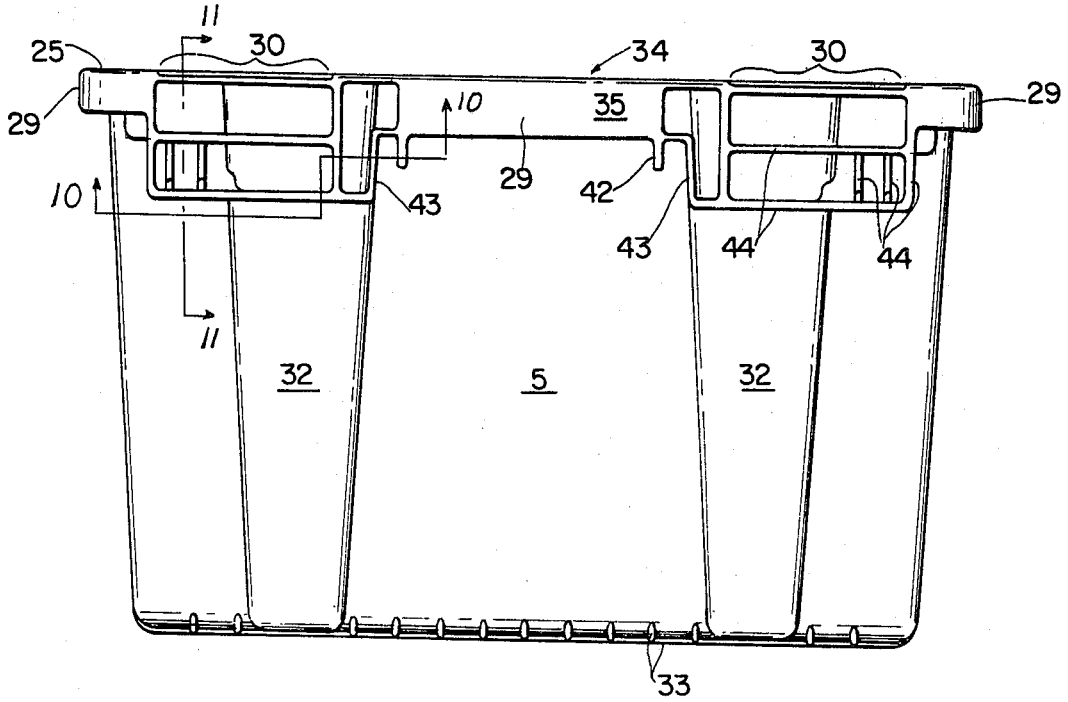
FIG. 5 is an elevation view of one end wall.

Each of the end walls is formed with two integral horizontally opening channel shaped columns, having the foot portions 8–11 closing their bottom and being open at their top, which provide column rigidity to stacked containers, free drainage, protection of the drainage holes against being covered by objects, and the above-mentioned stacking and nesting functions. The general U-shape is shown in FIG. 1, and from FIG. 5, for example, it is seen that the column extends for substantially the full height of the container.

Figure 2:
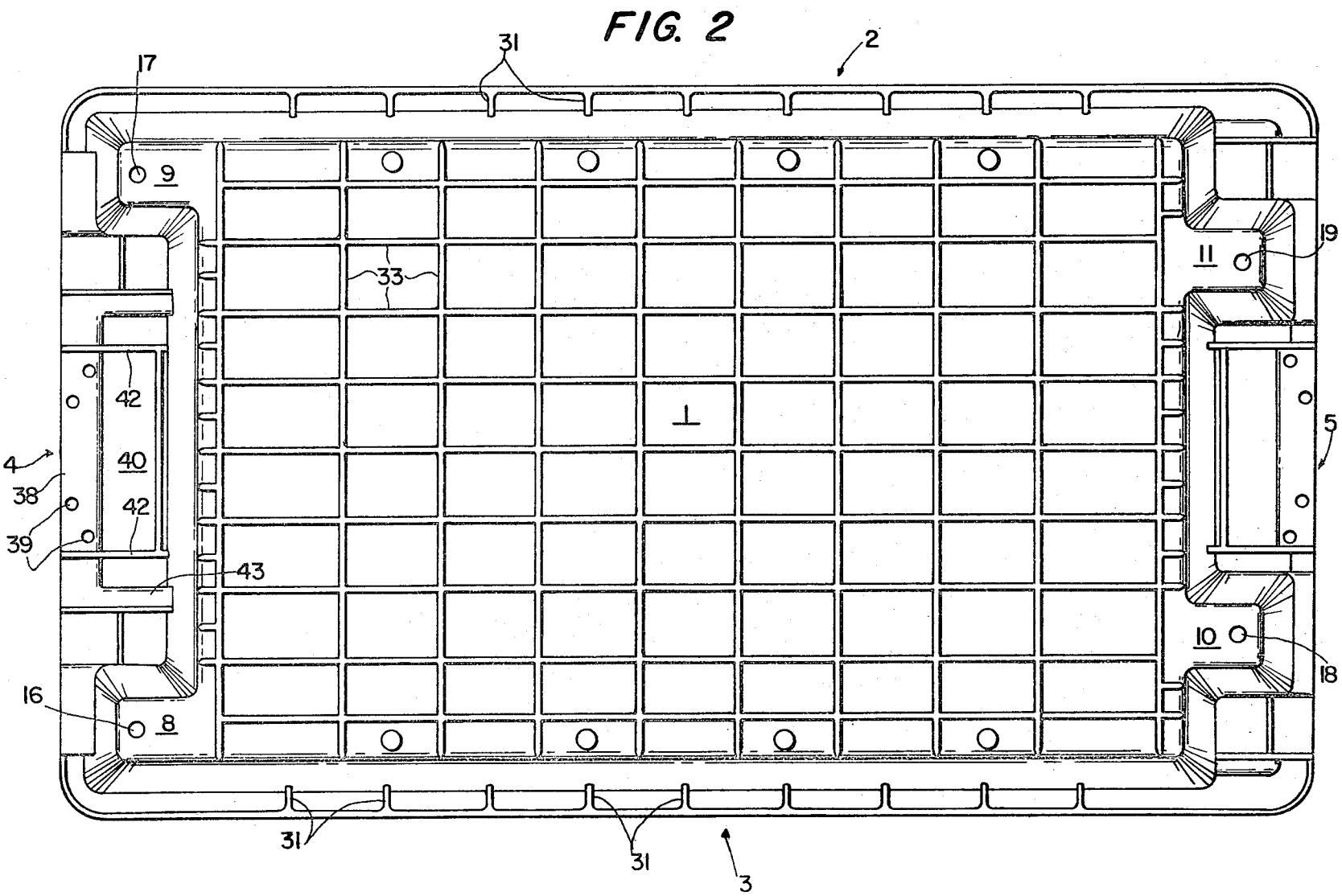
FIG. 2 is a bottom view thereof.
Figure 3:
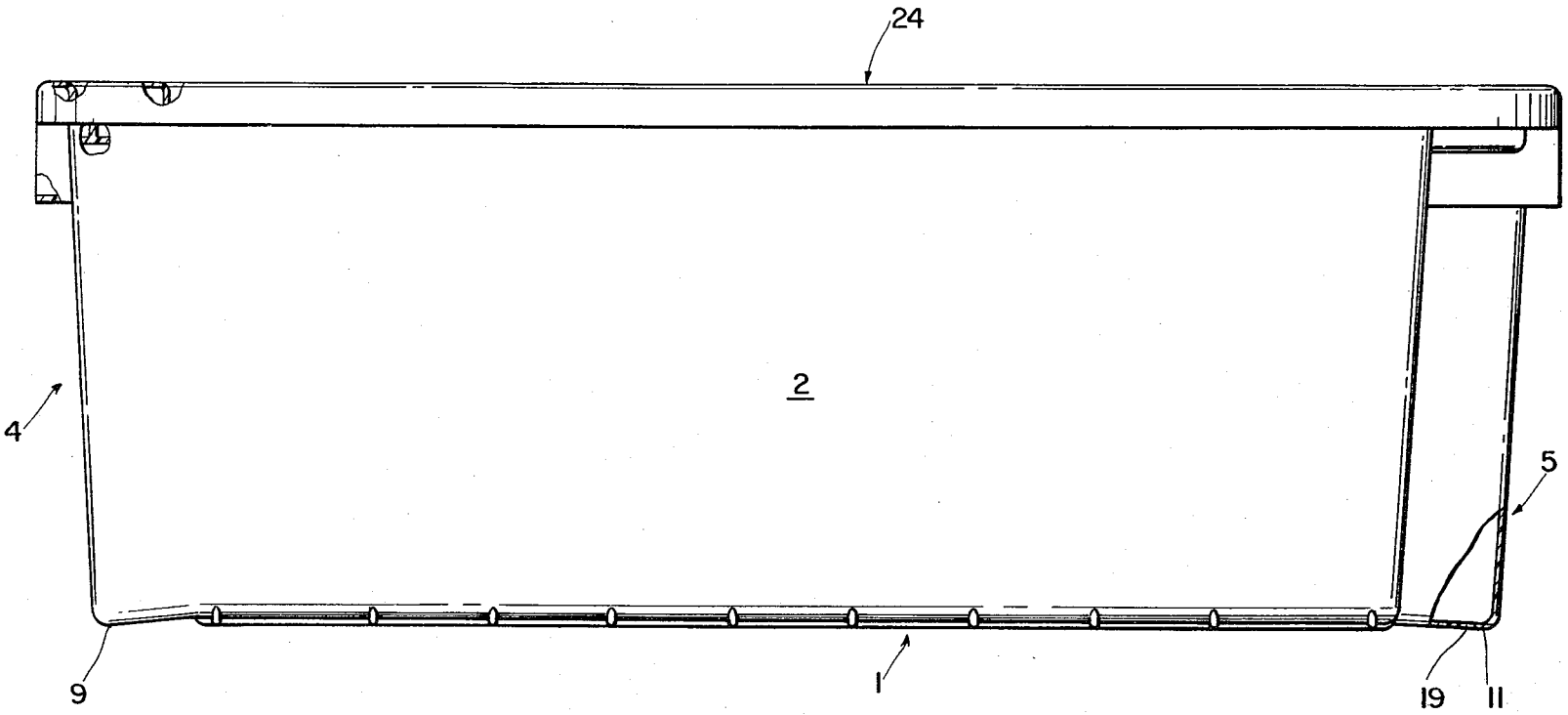
FIG. 3 is one side elevation view.
Figure 4:
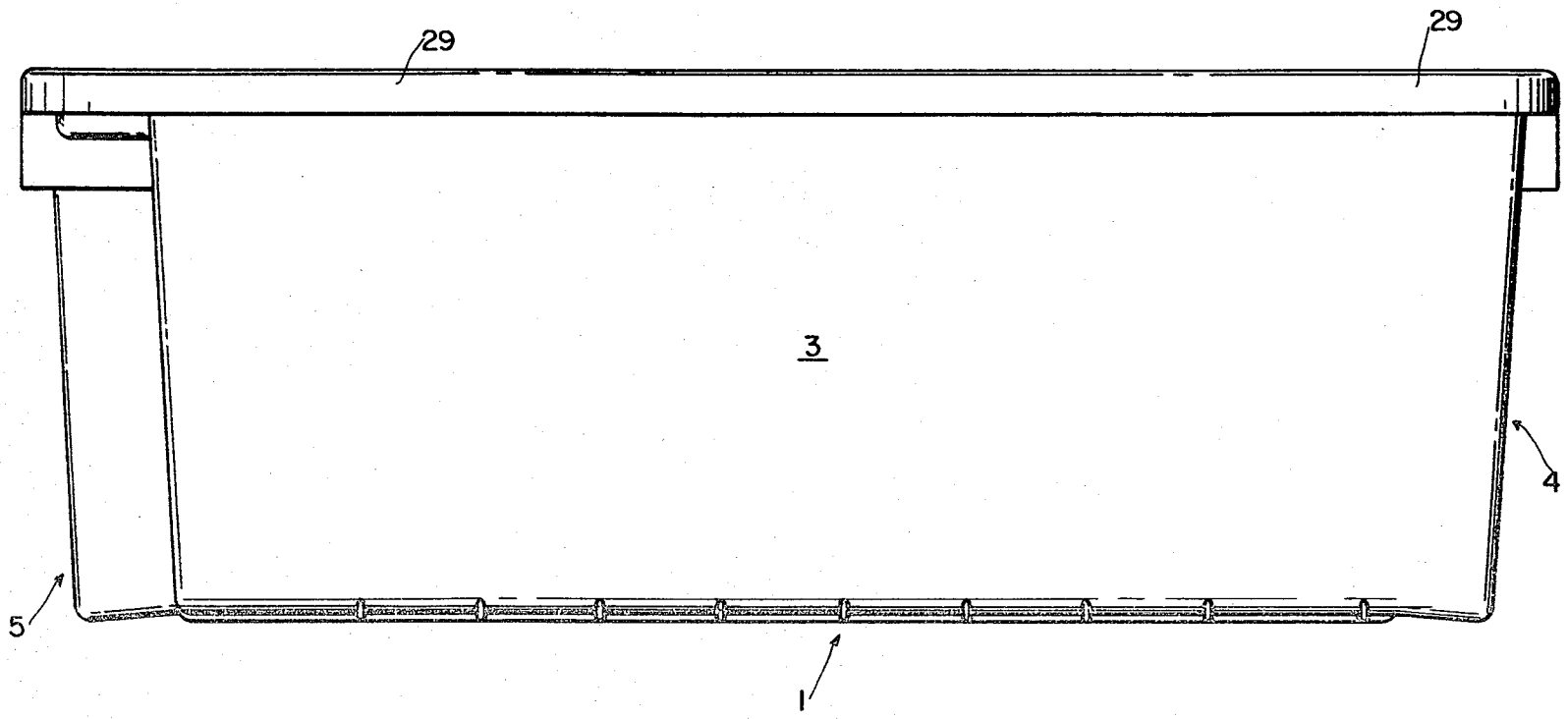
FIG. 4 is the other side elevation view thereof.
Figure 6:
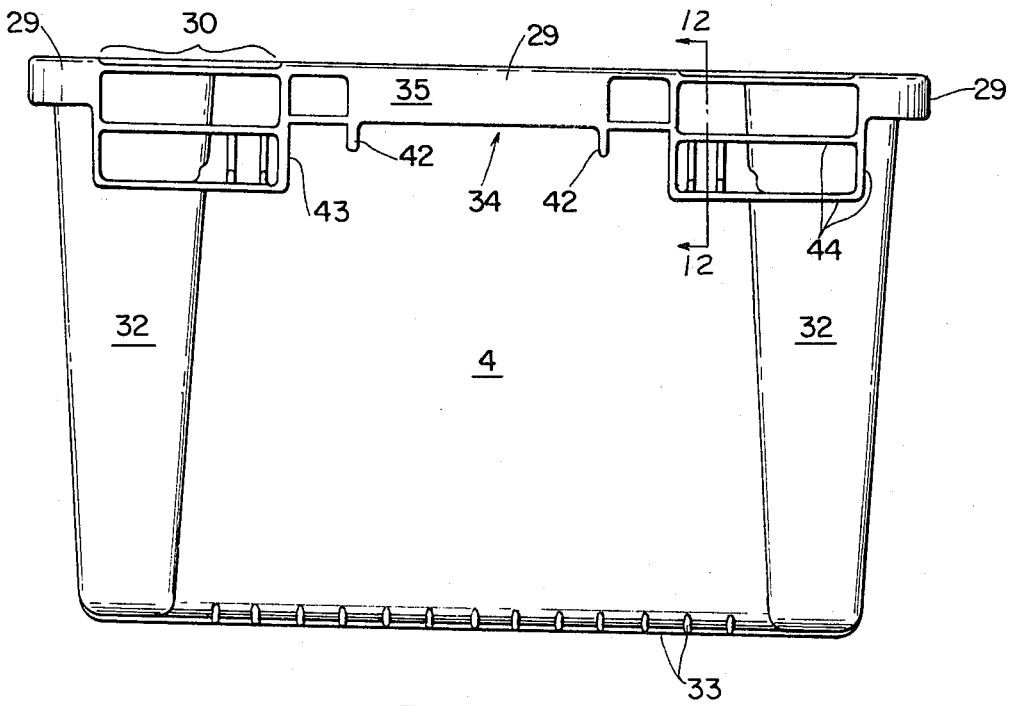
FIG. 6 is an elevation view of the other end wall.

Various features are provided for reinforcement of the container. As shown in FIG. 2, the bottom surface of the bottom is provided with a grid of downwardly extending flanges, which provide for bending or beam rigidity to the bottom, although they may be omitted if desired. As seen, for example in FIGS. 5, 6, the flange 24 includes a downwardly depending skirt wall portion 29, that extends integrally downwardly from the outermost edge of the flange wall portion 25. This skirt wall portion extends continuously around the entire periphery of the upper portion of the container, except in the drainage channel areas 30 of the two end walls 4, 5. A plurality of buttress type walls are integrally connected and extend perpendicular to the skirt wall portion 29, horizontal wall portion 25, and side walls 2, 3 at a plurality of spaced locations 31.

The container is molded with integral handles at each end, which are particularly shown in FIGS. 1, 2, 9, 5 and 6. The handles 34 are formed by three parallel vertical walls 35, 36, 37 of equal length, equal height for the two outer walls and lesser height for the inner wall 36. A horizontal wall 38 is of equal length with and joins the walls 35–37. Drain holes 39 are provided in the horizontal wall 38. The portion of the end wall 5 adjacent the handle is inwardly spaced from the handle as seen in plan view, FIG. 1, so that there is a vertical clearance space, of rectangular shape that is uninterrupted by any container structure for the full height of the container, to provide for entrance of the hand. The portion of the container wall 5 is provided with an outwardly extending and downwardly turned flange 41 to provide for a smooth upper edge in the vicinity of the handle, and otherwise the end walls and side walls extend for the full height of the container. The container includes four generally rectangular walls 42 adjacent the ends of the container and respectively integrally connected, at right angles, with the ends of the handle walls 35–38. These walls 42 further are connected along their inner edge to the container walls 5, 4, connected along their upper edge to the flange wall 25 and generally free along their remaining two edges; they further define the space 40. There are four additional walls 43, parallel to and outwardly spaced from respective walls 42.

The walls 43 extend somewhat lower than the walls 42, and are connected thereto by a portion of the end walls, 4,5, extensions of the handle walls 38, the flange horizontal wall 25, and extensions of the handle wall 37 to provide for further rigidity in the handle area and in the seat portion areas, as well as to protect the drainage channels. Further horizontal and vertical outwardly extending ribs 44 reinforce the connections between the seat portions and columns, as well as form an enclosure for the drainage channels. An additional downwardly extending rib 45 supports the drainage channel and is integrally connected to adjacent wall portions.

While a preferred embodiment has been described in detail, further embodiments, modifications and variations are contemplated within the spirit and scope of the present invention, even though some of the details are important with respect to the more narrow aspects of the present invention, all as defined by the following claims.

What is claimed is:

1. A stackable, nestable container with drainage, comprising:

a one-piece construction including a bottom, opposed upwardly, outwardly slanting side walls, and opposed upwardly, outwardly slanting end walls forming an open top generally rectangular container;

said container including means interacting with a second identical container for stacking at least the two containers in a first stacked position wherein the bottom of the upward container is adjacent the topmost portion of the side and end walls of the lower container and a second nested position of 180° relative rotation as between said containers about a vertical axle wherein the containers are telescopically nested with the bottom of the upper container adjacent the bottom of the lower container;

said means including two foot portions at the intersection of said bottom and each of said end walls, with each pair of diagonally opposite foot portions having one foot portion closely adjacent the respective side wall and the other foot portion being spaced from the respective side wall, and two seat portions adjacent the topmost portion of each end wall correspondingly closely adjacent and spaced inwardly from respective side walls, so that in said first stacked position the one end wall of the lower container is vertically aligned with the other end wall of the upward container and the foot portions engage respective seat portions to provide vertical support of the upward container on the lower container;

each of said foot portions having a bottom wall with a drainage hole for draining liquid within said container through said drainage holes to the exterior of said container;

a completely separate drainage channel with bottom and side walls extending from one end in each of said seat portions at a position vertically aligned with the drainage hole of an upward container in said first stacked position downwardly and outwardly directly through an adjacent wall of its container to an opposite terminal end at a position spaced outwardly from the top of said adjacent wall;

said container including an integral top flange as a part of said one-piece construction that extends horizontally around the upper periphery of said side and end walls in a loop with a portion vertically spaced above and covering said channel;

said terminal end having means discharging the drainage to fall freely along a vertical path spaced from said container and intersecting the top flange of the next lower container in said stacked position at a position spaced outwardly from its walls; and wall portions integrally connected in one piece with said top flange and channel walls to form a tubular passage including said channel.

2. The container according to claim 1, wherein the portion of said flange vertically aligned below each channel terminal end of an upward container in said first stacked position extends downwardly and outwardly in the vicinity of intersection, and the immediately adjacent inwardmost portion of said flange includes a vertical wall portion leading into a mid-portion of the adjacent channel;

said container including an integral top flange as a part of said one-piece construction that extends horizontally around the upper periphery of said side and end walls in a loop with a portion vertically spaced above and covering said channel; and wall portions integrally connected in one piece with said top flange and channel walls to form a tubular passage including said channel.

3. The container according to claim 2, wherein each of said channels includes a bottom wall extending as a ramp from immediately below the drain hole of the upper container in the first position outwardly perpendicularly to the adjacent end wall.

4. The container according to claim 1, wherein each of said channels includes a bottom wall extending as a ramp from immediately below the drain hole of the upper container in the first position outwardly perpendicularly to the adjacent end wall.

5. The container according to claim 1, wherein the bottom wall of each foot portion slopes downwardly and outwardly towards the adjacent container corner, and each of said seat portions has a bottom wall sloping downwardly and outwardly towards an adjacent container corner at substantially the same slope as the engaged foot portion bottom wall of an upper container in said stacked position.

6. The container according to claim 1, wherein each of said end walls includes two vertically extending upwardly and outwardly sloping U-shaped cross section columns terminating at their lower end with said foot portions and being open at their upper end in closely spaced horizontal relationship with an adjacent seat portion.

7. The container according to claim 5, wherein each of said end walls includes two vertically extending upwardly and outwardly sloping U-shaped cross section columns terminating at their lower end with said foot portions and being open at their upper end in closely spaced horizontal relationship with an adjacent seat portion.

8. The container according to claim 1, further including in one piece, at least one additional horizontally extending reinforcing flange parallel to and beneath said top flange and above each said channel, and being integrally connected along its horizontal length with the exterior of the adjacent end wall, and further including a plurality of vertical reinforcing webs extending integrally between each of said horizontal reinforcing flanges and said top flange.

9. The container according to claim 5, further including in one piece, at least one additional horizontally extending reinforcing flange parallel to and beneath said top flange and above each said channel, and being integrally connected along its horizontal length with the exterior of the adjacent end wall, and further including a plurality of vertical reinforcing webs extending integrally between each of said horizontal reinforcing flanges and said top flange.

10. The container according to claim 6, further including in one piece, at least one additional horizontally extending reinforcing flange parallel to and beneath said top flange and a bove each said channel, and being integrally connected along its horizontal length with the exterior of the adjacent end wall, and further including a plurality of vertical reinforcing webs extending integrally between each of said horizontal reinforcing flanges and said top flange.

11. The container according to claim 7, further including in one piece, at least one additional horizontally extending reinforcing flange parallel to and beneath said top flange and above each said channel, and being integrally connected along its horizontal length with the exterior of the adjacent end wall, and further including a plurality of vertical reinforcing webs extending integrally between each of said horizontal reinforcing flanges and said top flange.

12. The container according to claim 1, wherein said top flange extends uninterrupted completely around the entire upper periphery of said container and includes a generally rectangular through aperture outwardly of the midportion of each end wall to form a hand grip top flange portion outwardly of each aperture;

for each end of said container, the foot portions, drainage holes, channels and top flange aperture being aligned;

each hand grip portion of said top flange being spaced apart parallel portions having vertical walls integrally depending therefrom, and a web portion integrally connecting the lower end of said vertical walls and being provided with drainage holes therein so that said handle forms a generally U-shaped upwardly opening cross section.

13. The container according to claim 12, wherein the bottom wall of each foot portion slopes downwardly and outwardly towards the adjacent container corner, and each of said seat portions has a bottom wall sloping downwardly and outwardly towards an adjacent container corner at substantially the same slope as the engaged foot portion bottom wall of an upper container in said stacked position.

14. The container according to claim 12, wherein each of said end walls includes two vertically extending upwardly and outwardly sloping U-shaped cross section columns terminating at their lower end with said foot portions and being open at their upper end in closely spaced horizontal relationship with an adjacent seat portion.

15. The container according to claim 12, wherein the bottom wall of each foot portion slopes downwardly and outwardly towards the adjacent container corner, and each of said seat portions has a bottom wall sloping downwardly and outwardly towards an adjacent container corner at substantially the same slope as the engaged foot portion bottom wall of an upper container in said stacked position.

16. The container according to claim 12, further including in one piece, at least one additional horizontally extending reinforcing flange parallel to and beneath said top flange and above each said channel, and being integrally connected along its horizontal length with the exterior of the adjacent end wall, and further including a plurality of vertical reinforcing webs extending integrally between each of said horizontal reinforcing flanges and said top flange.

17. The container according to claim 16, wherein the bottom wall of each foot portion slopes downwardly and outwardly towards the adjacent container corner, and each of said seat portions has a bottom wall sloping downwardly and outwardly towards an adjacent corner at substantially the same slope as the engaged foot portion bottom wall of an upper container in said stacked position.

18. The container according to claim 16, wherein each of said end walls includes two vertically extending upwardly and outwardly sloping U-shaped cross section columns terminating at their lower end with said foot portions and being open at their upper end in closely spaced horizontal relationship with an adjacent seat portion.

19. The container according to claim 16, wherein the bottom wall of each foot portion slopes downwardly and outwardly towards the adjacent container corner, and each of said seat portions has a bottom wall sloping downwardly and outwardly towards an adjacent container corner at substantially the same slope as the engaged foot portion bottom wall of an upper container in said stacked position.

* * * * *